United States Patent [19]

Felser et al.

[11] 4,095,287

[45] June 13, 1978

[54] EMPTYING APPARATUS FOR PASTY MATERIALS

[75] Inventors: Hans-Josef Felser; Kurt Paul Kley, both of Cologne, Germany

[73] Assignee: Bonaval-Werke GmbH, Bonn, Germany

[21] Appl. No.: 663,425

[22] Filed: Mar. 3, 1976

[51] Int. Cl.[2] ..... B01F 15/02; B01F 7/20; B01F 9/10

[52] U.S. Cl. ..... 366/194; 222/168; 222/318; 366/311

[58] Field of Search ..... 242/85, 84, 90, 88, 242/33, 32, 31, 30, 8; 222/238, 318, 168

[56] References Cited

U.S. PATENT DOCUMENTS

| | | | |
|---|---|---|---|
| 1,956,788 | 5/1934 | Blum | 259/43 |
| 2,240,641 | 5/1941 | Dummler | 259/31 X |
| 2,651,582 | 9/1953 | Courtney | 259/85 X |
| 2,877,929 | 3/1959 | Ireland | 222/318 X |
| 3,472,429 | 10/1969 | Flentie | 242/318 |

*Primary Examiner*—Billy S. Taylor

[57] ABSTRACT

An emptying apparatus for pasty materials is disclosed. The apparatus consists of a cylindrical container and means for stirring pasty materials in the container. The container is equipped with a spiral pump associated with an adjustable strip baffle along the vertical wall of the container wherein the baffle strip can be adjusted to vary the angle the baffle makes with the container wall. The spiral pump is connected with a suitable outlet means such as a pipe which may be provided with a closure means such as a stopcock and an overflow pipe to return material to the container when the closure means is closed.

4 Claims, 2 Drawing Figures

EMPTYING APPARATUS FOR PASTY MATERIALS

For emptying pasty materials, such as spackle, putty, etc., devices are usually used by means of which the materials are pressed out of an appropriately shaped preparation vessel through an hydraulically driven pressure piston. These devices do in fact generally operate in a satisfactory manner, but they are technically quite cumbersome and proportionately expensive. Their use is therefore justified only when larger quantities of such materials must be constantly emptied.

An emptying apparatus is also known in which a horizontal spiral pump is built into the inclined floor of the preparation vessel. The spiral pump conveys the material into an emptying pipe with a stopcock. While an empty vat is being replaced by a full one, this stopcock is always closed. In order to achieve here a reasonably even emptying speed, and in order not to overload the pump drive motor by constantly switching it on and off, it is absolutely necessary here, in practice, to let the pump run on even when the stopcock is closed. An overpressure consequently builds up in the emptying pipe. This overpressure leads to undesirable changes in temperature and viscosity, which often considerably impair the quality of the materials. An attempt has already been made to circumvent these difficulties by the feed pipe of the spiral pump having a significantly larger diameter than the worm-gear situated within it. This procedure creates a back-flow path for the material being emptied. This back-flow path is situated between worm gear and the interior wall of the feed-pipe. As soon as the stopcock is closed, the materials flow from the pump exit back into the container. In this fashion, they reach the suction area of the pump, or at least its vicinity, so that a circulation soon appears. This circulation again leads to a temperature build-up of the circulating materials. This special design of the spiral pump could not solve the problem of increasing temperature. But apart from this fact, such a pump has exceedingly poor efficiency. This poor efficiency makes it necessary to use a pump that is overdimensioned compared with usual spiral pumps, in order to achieve adequate conveyance power. Another, very grave disadvantage of the known emptying apparatus consists in the fact that intake of the materials being emptied cannot be fully controlled on the suction side of the spiral pump, and continuous emptying is therefore not guaranteed. In fact, as soon as the pump has sucked in a certain volume, a vacuum arises in the area of the suction side of the pump. This vacuum arises because of the high viscosity of the poorly flowing materials. The resulting vacuum interrupts the conveyance process. All these disadvantages have resulted in this known emptying apparatus being unable to establish itself in practice.

This invention shall now create an emptying apparatus for pasty materials, which avoids the defects and difficulties of known devices, and which permits economical and unexceptionable emptying even of smaller amounts of such materials, without great technical and material effort.

The invention concerns an emptying apparatus for pasty materials, especially spackle and putty. The apparatus has an approximately cylindrical container for the materials, a spiral pump, an emtpying line with a closure organ, and a back-flow path leading back from the pump exit into the container. It is characterized by the container being positioned so as to be rotatable about its axis, and by the container being drivable by a motor. It is further characterized by a fixed baffle being provided, which extends eccentrically into the container, and by the spiral pump being vertically arranged so as to extend from the top into the container, in the stagnation region of the baffle. It is further characterized by the back-flow path being formed by a separate overflow line.

The emptying apparatus according to the invention not only avoids the defects of the known apparatus, but in addition has the great advantage that it can very simply be assembled from apparatus and construction elements that are generally present anyway in the relevant industry. For this purpose, mixers with eccentrically arranged stirring elements are particularly suitable, since such mixers already have all the elements of the new emptying apparatus, except for the spiral pump and the overflow line. By building in a standard spiral pump with emptying pipe and emptying head (e.g. stopcock) and an overflow line, such a mixer can simply be adapted as an emptying apparatus. On the one hand, this makes it possible to keep costs for the new emptying apparatus extremely low, and on the other hand it extends quite considerably the area of applicability of such a mixer.

The invention is explained in more detail below, by means of an embodiment shown in the drawing.

Figure 1:
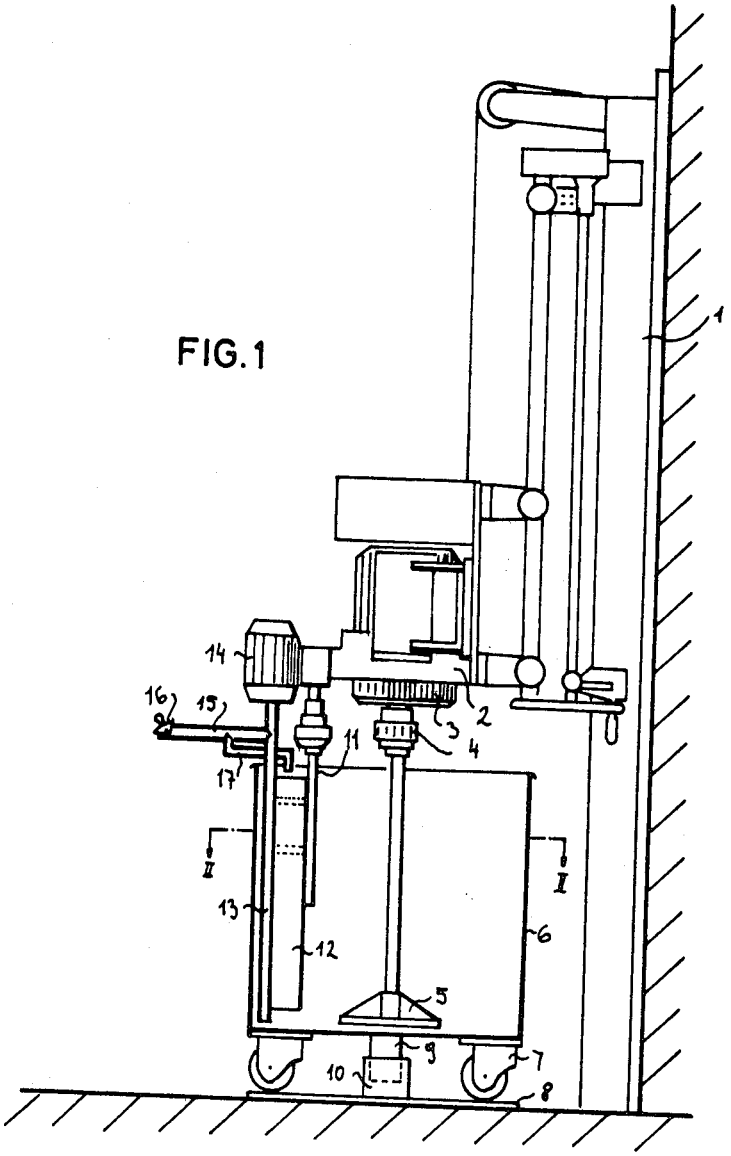
FIG. 1 shows a side view of the embodiment, partially in section.
Figure 2:
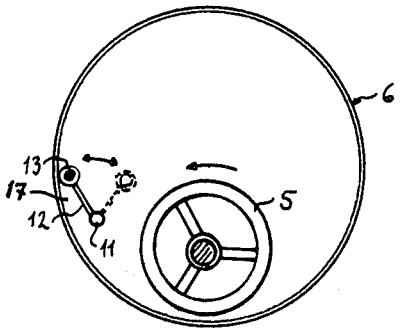
FIG. 2 shows a section according to the line II—II of FIG. 1.

The emptying device shown in FIG. 1 corresponds in its construction essentially to a modified mixer with an eccentric stirring element. On a frame 1, a support 2 is mounted so as to be movable in the vertical direction. An electric motor 3 is arranged on the support in such a way that its axis is vertical. The electric motor 3 is connected through a coupling 4 with a stirring element 5. The electric motor 3 drives the stirring element 5 in the direction of rotation indicated by the arrow in FIG. 2.

A cylindrical container 6 is located below support 2. Container 6 is rotatably mounted on an approximately horizontal smooth base 8 by means of guide rollers 7. A bearing neck 9 is affixed to the underside of the container for centering purposes. Bearing neck 9 meshes with an appropriately designed bearing 10 on base 8. Bearing 10, and consequently the location of the rotation axis of container 6, are arranged in such a way that the stirring element 5 extends eccentrically into container 6, as is clearly apparent from FIG. 2.

Furthermore, a mount 11 for a strip-shaped baffle 12 is affixed to support 2. The baffle 12 extends into container 6 approximately parallel to the latter's axis and in the vicinity of its wall. The baffle's angle of approach to the wall, and consequently the effective stagnation surface, and thus the stagnation region 17, can be adjusted between two end positions shown in FIG. 2. A spiral pump 13 is arranged at the free vertical edge of the baffle 12. It is likewise connected to mount 11 by means of fixing elements which are not shown in more detail. The diameter of the feed-pipe of the spiral pump exceeds that of the worm gear only by the usual mounting play. What is involved, therefore, is a standard spiral pump. The pump 13 is driven by an electric motor 14, which is likewise affixed to mount 11. An emptying pipe 15 is connected to the upper end, on the pressure side, of spiral pump 13. At its outlet, the decanting pipe 15 is equipped with an emptying head (e.g. a stopcock) 16. An overflow line 17 branches from the emptying pipe. The diameter of the overflow line 17 is preferably half that of the emptying pipe. The overflow line 17 leads back into the container 6.

At the beginning of the emptying process, the motor of the stirring element 5 is switched on. The materials are set in motion through the stirring element, are heated slightly, and are thoroughly mixed. Here the viscosity is lowered somewhat. The container is rotated about the bearing 9, 10 with a rotational speed that depends on the position of the baffle 12.

During this process, new materials are constantly being led to the spiral pump 13, which is located in the stagnation region of baffle 12. No diminution of materials can therefore occur in the suction region of the pump, so that flawless continuous conveyance is assured.

The rotational speed of the container is increased towards the end of the emptying process. This measure achieves the object of pressing the remaining mass against the outer wall because of the centrifugal forces that are generated. In this way, the remaining mass is pressed into the stagnation region of the pump. In this fashion, it is possible to empty nearly without loss.

The pump 13 conveys the materials into the emptying pipe 15. When the emptying head (e.g. stopcock) 16 is open, the materials proceed from there into a vat, which is not shown. When the emptying head is closed, the spiral pump 13 pumps the materials through the overflow line 17 back into the container 6. The materials that are brought back in this way are not immediately again sucked in by the pump. Consequently, increases in temperature, on the basis of material short-circuit coupling, cannot occur.

The emptying apparatus described above flawlessly solves the problem of conveying material to the spiral pump and of the rising of the emptied materials' temperature when the stopcock is closed. The emptying apparatus is technically quite simple. Consequently, it is robust and only minimally liable to fail. Furthermore, it is relatively economical, since it can for the most part be assembled from the construction elements of a mixer with an eccentric stirring pane, or such a mixer can easily be adapted as an emptying apparatus by building in a spiral pump.

We claim:

1. An emptying apparatus for pasty materials comprising a cylindrical container which is rotatable about its axis by means of an eccentrically located stirring element within the container, a strip-shaped baffle extending along the wall of the cylindrical container approximately parallel to the container axis, said baffle having one vertical edge mounted to rotate in fixed vertical positions about its vertical axis and the other free edge being free and movable to different vertical positions, so that the angle which the said baffle makes with the container wall can be adjusted, a spiral pump, means attaching said spiral pump to the free edge of the baffle and an outlet pipe attached to the pump outlet.

2. An emptying apparatus as claimed in claim 1 wherein the outlet pipe is provided with a closing means and an overflow pipe connecting the outlet pipe with the container.

3. An emptying apparatus for pasty materials comprising a cylindrical container having a flat closed end thereof in horizontal position, said container being rotatable about its vertical axis on guide rollers and bearings attached to the underside of the flat end, an eccentrically located stirring means extending downwardly into the container, a strip-shaped baffle extending along the inside wall of the container approximately parallel to the vertical axis of the container, said baffle having one vertical edge mounted to rotate in fixed vertical position about its vertical axis and the other edge of said baffle being free and movable to different vertical positions, so that the angle which the said baffle makes with the container wall can be adjusted, a spiral pump, means attaching said spiral pump to the free edge of the baffle, and an outlet pipe attached to the pump outlet.

4. An emptying apparatus as claimed in claim 3 wherein the outlet pipe is provided with a closing means and an overflow pipe connecting the outlet pipe with the container.

* * * * *